US006204827B1

(12) United States Patent
Endo et al.

(10) Patent No.: US 6,204,827 B1
(45) Date of Patent: Mar. 20, 2001

(54) ANTENNA FEEDING CIRCUIT

(75) Inventors: Tsutomu Endo; Toru Fukasawa; Moriyasu Miyazaki; Isamu Chiba, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/404,380

(22) Filed: Sep. 24, 1999

(30) Foreign Application Priority Data

Sep. 28, 1998 (JP) ..... 10-273304

(51) Int. Cl.[7] ..... H01Q 1/38
(52) U.S. Cl. ..... 343/895; 333/115
(58) Field of Search ..... 343/895, 858; 333/115, 109, 246

(56) References Cited

U.S. PATENT DOCUMENTS 5,541,617 * 7/1996 Connolly et al. ..... 343/895
6,034,650 * 3/2000 Kuramoto ..... 343/895

FOREIGN PATENT DOCUMENTS 61-205002 9/1986 (JP) .
6090108 3/1994 (JP) .
7058858 6/1995 (JP) .
10-256823 3/1998 (JP) .
10-507614 7/1998 (JP) .

OTHER PUBLICATIONS

Shumaker, P.K.., et al., "A New GPS Quadrifilar Helix Antenna", IEEE, 1996, pp. 1966–1969.
Agius, A.A., et al., Antenna Design for the ICO Handheld Terminal, CCSR, University of Surrey, U.K., 10th Inter. Conf. on Antennas and Propagation, Apr. 14–17, 1997, Conf. Pub. No. 436, pp. 1.385–1.389.

* cited by examiner

*Primary Examiner*—Don Wong
*Assistant Examiner*—James Clinger
(74) *Attorney, Agent, or Firm*—Rothwell, Figg, Ernst & Manbeck

(57) ABSTRACT

An object of the present invention is to provide an antenna feeding circuit, which requires no balance-unbalance converter and has a simplified structure.

The object is attained, by an antenna feeding circuit, according to the present invention, in which micro-strips lines are constituted from one or more pair(s) of band conductors (5*a*, 5*b*) disposed on the outer surface of the cylindrical body (1) and an inner conductor (6) disposed on the whole of the inner surface of the cylindrical body (1). A 180 degree distributor (2) supplies electric power to the band conductors (5*a*, 5*b*) so that the phase difference between the currents in the band conductors (5*a*, 5*b*) is 180 degrees.

Inutile current induced in the inner surface of the inner conductor can be cancelled out, because the inner conductor 6 is disposed on the whole of the inner surface of the cylindrical body (1).

9 Claims, 8 Drawing Sheets

ANTENNA FEEDING CIRCUIT

BACKGROUND OF THE INVENTION

1. Field of the invention

The present invention relates to an antenna feeding circuit for an helical antenna, especially, a bifilar, quadrifilar and an octifilar helical antenna. A bifilar helical antenna is a helical antenna furnished with two filaments, a quadrifilar helical antenna is a helical antenna furnished with four filaments and an octifilar helical antenna is a helical antenna furnished with eight filaments.

2. Description of the prior art

Such an antenna feeding circuit is known, for example, from a "¼ turn volute with split sheath balun" shown in FIG. 6 in "Resonant Quadrifilar Helix Antenna" disclosed in "Microwave Journal", December, 1970, p49–53.

FIG. 12 is a schematic perspective view of an antenna feeding circuit in the prior art, more specifically, it shows a ¼ turn volute with split sheath balun disclosed in the article. In the figure, reference numerals 61, 62 denote, respectively, a first helical antenna element and a second helical antenna element. Reference numerals 63, 64 denote, respectively, a coaxial cable for feeding the helical antenna and a ¼ wavelength slit disposed on the outer conductor of the coaxial cable 63. Reference numeral 65 denotes an impedance converter disposed on the inner conductor of the coaxial cable 63. Electric power is fed to the first and second helical antenna elements 61, 62 from an electric power feeding point 66.

Regarding the function, the first and second helical antenna elements 61, 62 can be assumed to be balanced lines, similar to a pair of parallel two lines. When unbalanced lines, for example, such as a coaxial cable, are connected to a helical antenna, a balance-unbalance converter is required between the helical antenna elements 61, 62 and the coaxial cable. Therefore, a balun, constituted by the coaxial cable 63, the ¼ wavelength slit 64 and the impedance converter 65, is disposed as a balance-unbalance converter. Another function of this balun is to cancel out an inutile current, which appears when a balanced line is connected to an unbalanced line.

Japanese Patent Application 63-30006-A discloses another antenna feeding circuit, which comprises a ¼ wavelength slit disposed on the outer conductor of a coaxial cable. The antenna comprises two sets of antenna elements, having an equal pitch angle, and each set of antenna elements is connected to one of two connecting portions of a connecting piece. The structure of this antenna feeding circuit facilitates the assembling of the antenna, and improves the preciseness of dimensions of the components of the antenna feeding circuit.

The antenna feeding circuits in the prior arts have following drawbacks due to such structures:

A balun is of a rather long dimension, i.e., ¼ wavelength, in the longitudinal direction of an antenna;

The structure is rather complicated, as for example, when a coaxial structure of the antenna portion and the feeding circuit portion is employed to shorten the total length of the system including the length of the antenna portion.

SUMMARY OF THE INVENTION

An object of the present invention is to propose an antenna feeding circuit, which can eliminate such drawbacks in the prior art.

Another object of the present invention is to propose an antenna feeding circuit, which requires no balance-unbalance converter (balun), such as used in the prior art, and has a simple structure.

The objects are attained by the antenna feeding circuit, according to the present invention, comprising:

- an inner conductor disposed on the inner surface of a cylindrical body;
- a pair of band conductors disposed on the outer surface of the cylindrical body at a position symmetrical with respect to the axis of the cylinder so as to be parallel with the longitudinal direction of the cylinder;
- a 180 degree distributor, connected to an end of each of the band conductors, for supplying electric power to each of the band conductors, so that the phase difference between the currents in the band conductors is 180 degrees; and
- a helical antenna, each element of the helical antenna corresponds to one of the band conductor and is connected to the other end of the band conductors.

In an embodiment of the antenna feeding circuit according to the present invention, the band conductors comprise an impedance matching circuit.

In an embodiment of the antenna feeding circuit according to the present invention, the band conductors comprise a capacitor element as an impedance matching circuit.

In an embodiment of the antenna feeding circuit according to the present invention, the band conductors comprise a meander line as an impedance matching circuit.

In an embodiment of the antenna feeding circuit according to the present invention, the band conductors comprise a short stub as an impedance matching circuit.

In an embodiment of the antenna feeding circuit according to the present invention, the 180 degree distributor comprises:

- a T-branching circuit having an input terminal and a pair of output terminals, which are T-branched from the input terminal; and
- a delay line connected to either of the output terminals, the electric length of the delay line is identical to a half of the wavelength at the frequency in use.

In an embodiment of the antenna feeding circuit according to the present invention, the 180 degree distributor comprises: a T-branching circuit comprising a first micro-strips line as an input terminal and a second and third micro-strips lines as output terminals, which are T-branched from the first micro-strips line; and a slot disposed on the substrate of the T-branching circuit so as to be perpendicular to the first micro-strips line, the length of the slot is substantially a half of the wavelength of the frequency in use; wherein the first micro-strips line is grounded to the substrate at a point in the opposite side to the input side of the first micro-strips line with respect to the slot; the second micro-strips line is disposed at the same side to the input side of the first micro-strips line and is grounded to the substrate at a point in the opposite side to the input side of the first micro-strips line with respect to the slot; the third micro-strips line is disposed at the opposite side to the input side of the first micro-strips line and is grounded to the substrate at a point in the same side to the input side of the first micro-strips line with respect to the slot.

The antenna feeding circuit according to an embodiment of the present invention comprises: an inner conductor disposed on the inner surface of a cylindrical body; first and second pairs of band conductors disposed on the outer surface of the cylindrical body at a position symmetrical with respect to the axis of the cylinder so as to be parallel with the longitudinal direction of the cylinder; first and second 180 degree distributors connected to an end of a band conductor in each pair of the band conductors, for supplying electric powers to each of the band conductors, so that the phase difference between the currents in the band conductors in each group of the band conductors is 180 degrees; a 90 degree distributor connected to the first and second 180 degree distributor, for supplying electric power to each of the first and second 180 degree distributors so that the phase difference between the input electric power to the first and second 180 degree distributors is 90 degrees; and a quadrifilar helical antenna, each element of the quadrifilar helical antenna corresponds to one of the band conductor and is connected to the other end of the band conductor.

The antenna feeding circuit according to an embodiment of the present invention comprises: an inner conductor disposed on the inner surface of a cylindrical body; first to fourth pairs of band conductors disposed on the outer surface of the cylindrical body at a position symmetrical with respect to the axis of the cylinder so as to be parallel with the longitudinal direction of the cylinder; first to fourth 180 degree distributors, connected to an end of a band conductor in each pair of the band conductors, for supplying electric power to each of the band conductors, so that the phase difference between the currents in the band conductors in each pair of the band conductors is 180 degrees; a first 90 degree distributor connected to the first and third 180 degree distributor, for supplying electric power to each of the first and third 180 degree distributors so that the phase difference between the input electric power to the first and third 180 degree distributors is 90 degrees; a second 90 degree distributor connected to the second and fourth 180 degree distributor, for supplying electric power to each of the second and fourth 180 degree distributors so that the phase difference between the input electric power to the second and fourth 180 degree distributors is 90 degrees; and an octifilar helical antenna comprised of two sets of quadrifilar helical antenna, elements in each set of quadrifilar helical antenna are connected to the other end of a band conductor in the first to fourth pair of the band conductors.

DETAILED DESCRIPTION OF THE PREFERRED EMBODIMENT

Embodiments of the present invention are explained below.

EMBODIMENT 1

Figure 1:
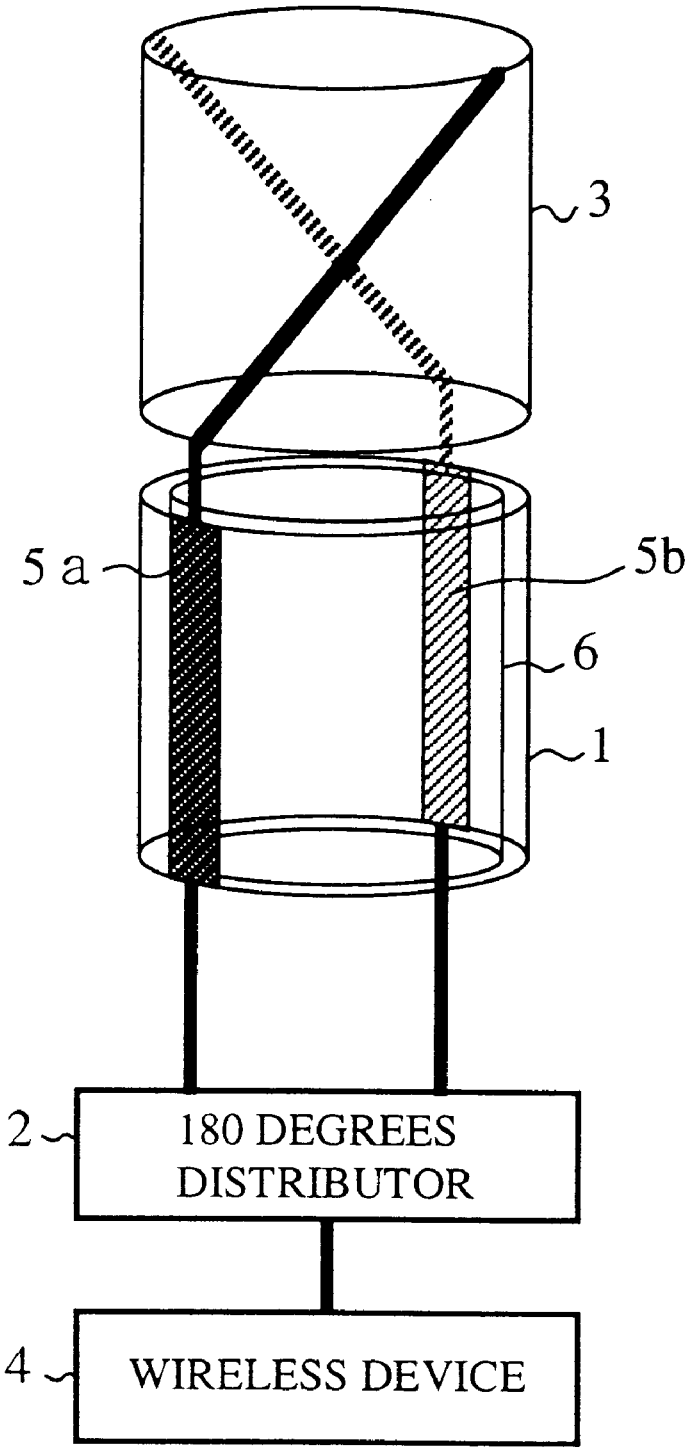
FIG. 1 is a schematic view of an antenna feeding circuit according to the first embodiment of the present invention.

FIG. 1 is a schematic view of an antenna feeding circuit according to the first embodiment of the present invention. Reference numeral 1 denotes an electrically insulating cylindrical body. A pair of band conductors 5*a*, 5*b* are disposed on the outer surface of the cylindrical body 1 at positions symmetrical with respect to the axis of the cylinder so as to be parallel with the longitudinal direction of the cylinder. The whole of the inner surface of the cylindrical body 1 is covered with an inner conductor 6. The band conductors 5*a*, 5*b*, the cylindrical body 1 and the inner conductor 6 form micro-strips lines.

A 180 degree distributor 2 is connected to an end of each band conductors 2, which supplies electric power to the band conductors 5*a*, 5*b*, so that the phase difference between the currents supplied to the band conductors is 180 degrees. A bifilar helical antenna 3 is connected to the other end of the band conductors 5*a*, 5*b*. Reference numeral 4 denotes a wireless device, which provides electric power to the 180 degree distributor 2.

The function of the antenna feeding circuit according to the first embodiment of the present invention is explained below.

Figure 2:
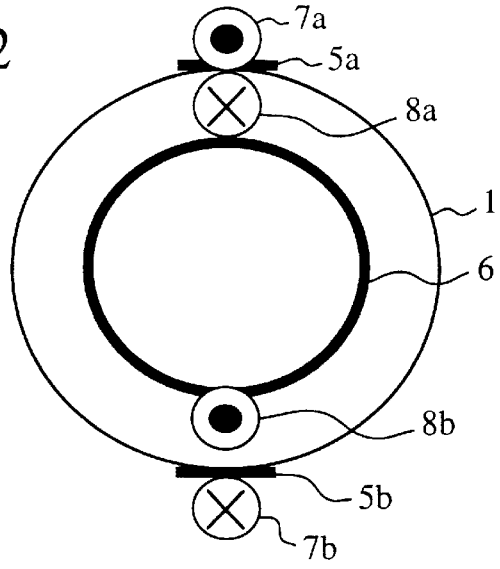
FIG. 2 is a cross-sectional view of a cylindrical body in an antenna feeding circuit according to the first embodiment of the present invention, showing the directions of currents flowing in band conductors.

FIG. 2 is a cross-sectional view of a cylindrical body in an antenna feeding circuit according to the first embodiment of the present invention, showing the directions of currents flowing in band conductors.

The 180 degree distributor 2 supplies electric power to the band conductors 5*a*, 5*b*, so that a phase difference between the currents in the band conductors is 180 degrees. Therefore, the directions of the current 7*a*, 7*b* flowing in the band conductors 5*a*, 5*b* are inverse to each other. Each current 7*a*, 7*b* induces currents 8*a*, 8*b* on the outer surface of the inner conductor 6 at a position corresponding to each of the band conductors 5*a*, 5*b*, because they form micro-strips lines. The directions of the induced current 8*a*, 8*b* are inverse to each other. The induced currents 8*a*, 8*b* flow in the inner conductor 6 covering the inner surface of the cylindrical body, so that the directions of the induced current 8*a*, 8*b* are inverse to each other.

Figure 3:
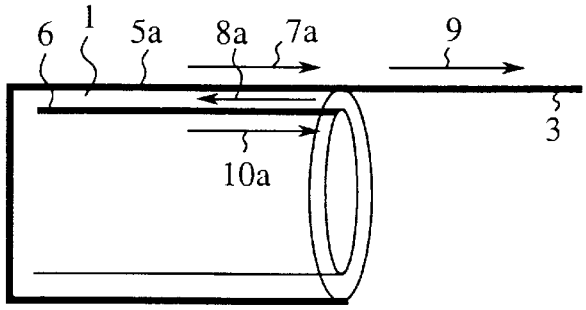
FIG. 3 shows the directions of currents flowing in a band conductor according to the first embodiment and a helical antenna connected with the band conductor.

FIG. 3 shows the directions of currents flowing in a band conductor according to the first embodiment and a helical antenna connected with the bane conductor. The current 7*a* flowing in the band conductor 5*a* flows into one of the bifilar antenna elements 3, as an antenna current 9. However, the induced current 8*a* flowing on the outer surface of the inner conductor 6 corresponding to the current 7*a* in the band conductor 5*a* induces an inverse inutile current 10*a* on the inner surface of the inner conductor 6. Similarly, the current 7*b* (not shown) flowing in the band conductor 5*b* induces an inutile current 10*b* (not shown) on the inner surface of the inner conductor 6 at a corresponding portion. When these inutile currents flow into the 180 degree distributor 2 and to the wireless device 4, the functions of antenna system will be influenced by these inutile currents, and an inutile electromagnetic wave will be emitted.

Figure 4:
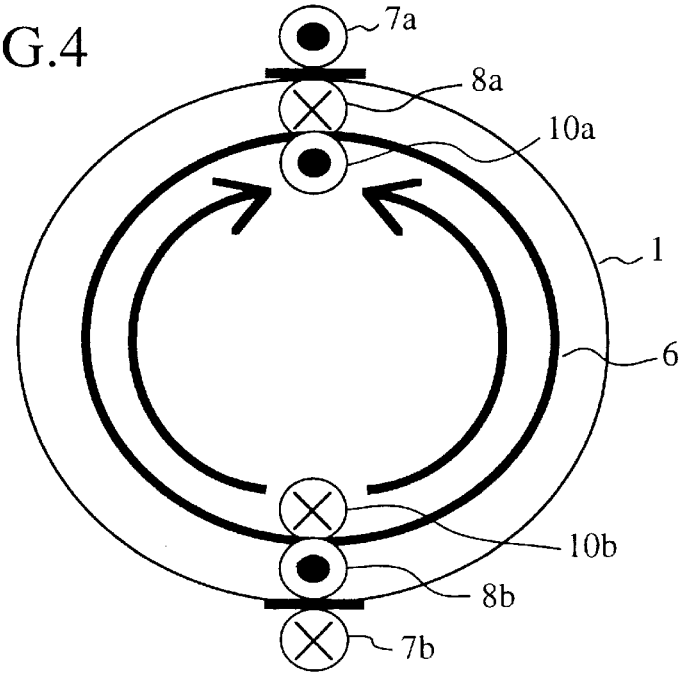
FIG. 4 is a cross-sectional view of a cylindrical body in an antenna feeding circuit according to the first embodiment of the present invention, showing the directions of currents flowing in the band conductors and in the inner conductor, when a helical antenna is connected to the band conductor.

FIG. 4 is a cross-sectional view of a cylindrical body 1 in an antenna feeding circuit according to the first embodiment of the present invention, showing the directions of currents flowing in the band conductors 5*a*, 5*b* and in the inner conductor 6, when a helical antenna 3 is connected to the band conductor 5*a*, 5*b*. It can be seen from the figure that the directions of the inutile currents 10*a*, 10*b*, which respectively corresponding to the band conductors 5*a*, 5*b*, are inverse to each other. However they are cancelled out by each other, because they are connected to each other by the inner conductor 6 disposed on the whole of the inner surface of the cylindrical body 1. Therefore the antenna system is not influenced by the inutile currents 10, 10*b*. As a result, it is not necessary to use a balanced-unbalanced converter, i.e., a balun, which is used in such an antenna system in the prior art.

As explained above, according to the first embodiment, a pair of band conductors 5*a*, 5*b* disposed on the outer surface of the cylindrical body 1 and the inner conductor 6 disposed on the whole of the inner surface of the cylindrical body 1 form micro-strips lines respectively, and a 180 degree distributor 2 supplies electric power to the pair of the band conductor 5*a*, 5*b*. The induced inutile currents in the inner conductor are cancelled out by each other, because the inner conductor is disposed on the whole of the inner surface of the cylindrical body. As a result, a balance-unbalance converter, a balun, is not necessary, and the structure of the antenna feeding circuit can be simplified.

EMBODIMENT 2

Figure 5:
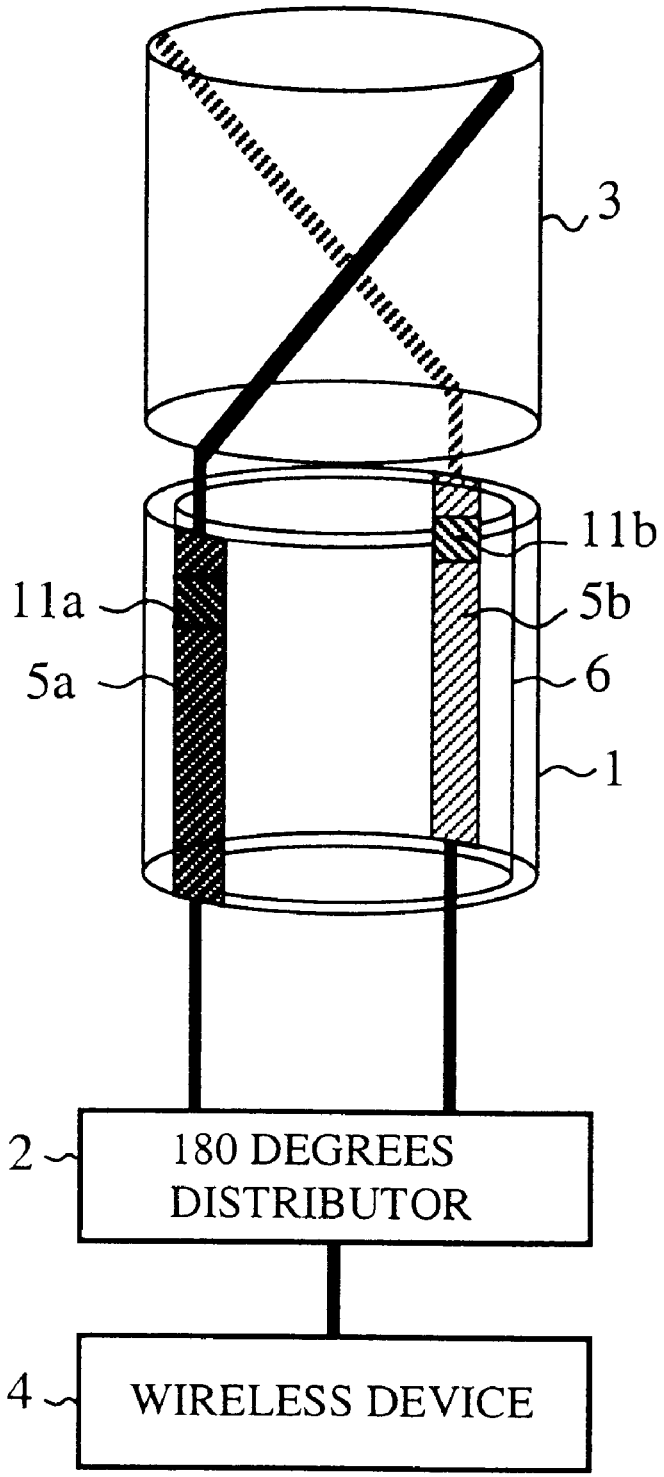
FIG. 5 is a schematic view of an antenna feeding circuit according to the second embodiment of the present invention.

FIG. 5 is a schematic view of an antenna feeding circuit according to the second embodiment of the present invention. In this embodiment, a chip capacitor 11*a*, 11*b* as a capacitor element is connected to each of the band conductors 5*a*, 5*b*. The capacitor element is not limited to a chip element 11*a*, 11*b*, and can be replaced by any other capacitor element. Components in the figure identical to those in the first embodiment shown in FIG. 1 are referred to the same reference numerals.

The function of the antenna feeding circuit according to the second embodiment of the present invention is explained below.

The band conductor 5*a*, 5*b* and the inner conductor 6 disposed on the whole of the inner surface of the cylindrical body 1 form micro-strips lines, respectively, so that the inutile currents in the inner conductor are cancelled out by each other in like manner as in the first embodiment. Furthermore the impedance matching between the band conductors 5*a*, 5*b* and the bifilar helical antenna element 3 is carried out by the chip capacitors 11*a*, 11*b* connected to the band conductors 5*a*, 5*b*.

According to the second embodiment, advantages can be obtained in that the structure of the antenna feeding circuit can be simplified; and that electric power can be effectively supplied to the bifilar antenna elements 3, using chip capacitors 11*a*, 11*b* as impedance matching elements, so that the efficiency of the electromagnetic wave radiation can be improved.

EMBODIMENT 3

Figure 6:
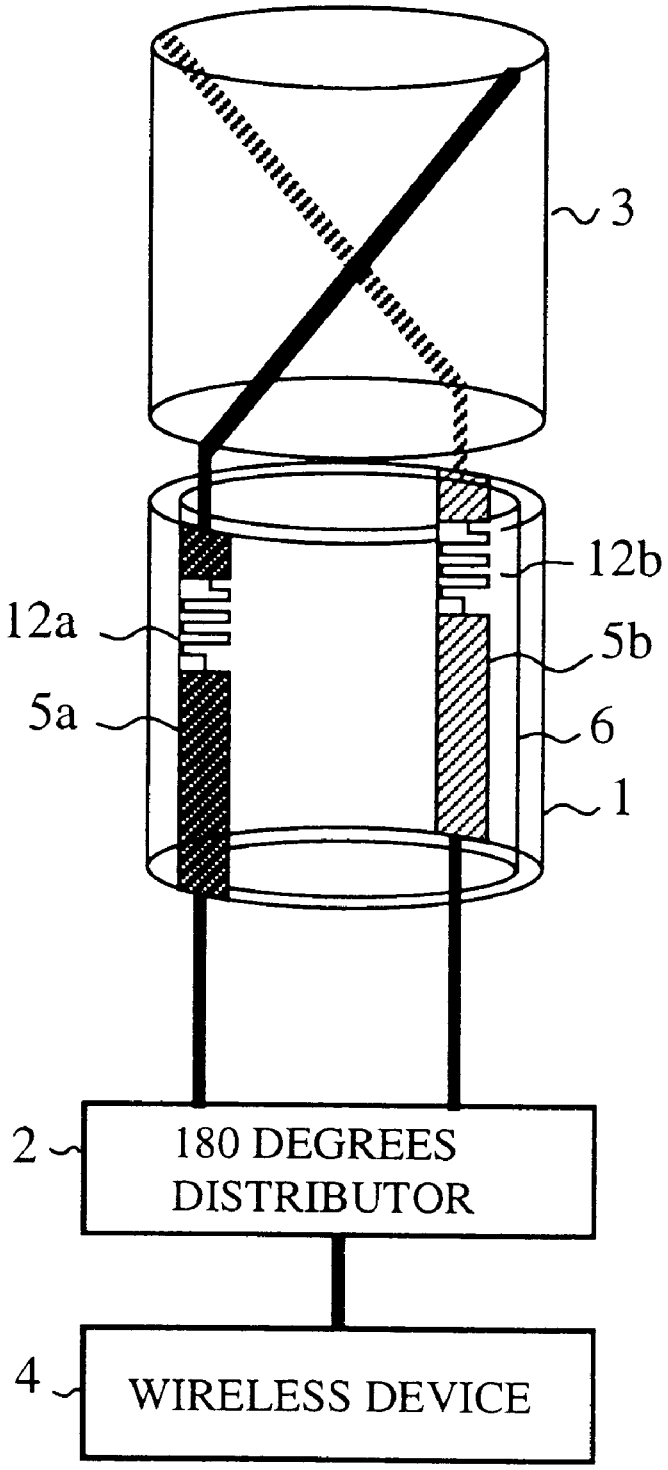
FIG. 6 is a schematic view of an antenna feeding circuit according to the third embodiment of the present invention.

FIG. 6 is a schematic view of an antenna feeding circuit according to the third embodiment of the present invention. In this embodiment, meander lines 12*a*, 12*b* are connected respectively to the band conductors 5*a*, 5*b*. Components in the figure identical to those in the first embodiment shown in FIG. 1 are referred to the same reference numerals.

The function of the antenna feeding circuit according to the third embodiment of the present invention is explained below.

The band conductors 5*a*, 5*b* and the inner conductor 6 disposed at the whole of the inner surface of the cylindrical body 1 form micro-strips lines, respectively, so that the inutile currents in the inner conductor are cancelled out to each other in like manner as in the first embodiment. Furthermore the impedance matching between the band conductors 5*a*, 5*b* and the bifilar helical antenna element 3 are carried out by the meander lines 12*a*, 12*b* connected to the band conductors 5*a*, 5*b*.

As explained, according to the third embodiment, advantages can be obtained in that the structure of the antenna feeding circuit can be simplified; and that electric power can be effectively supplied to the bifilar antenna elements 3, using meander lines 12*a*, 12*b* as impedance matching elements, so that the efficiency of the electromagnetic wave radiation can be improved.

EMBODIMENT 4

Figure 7:
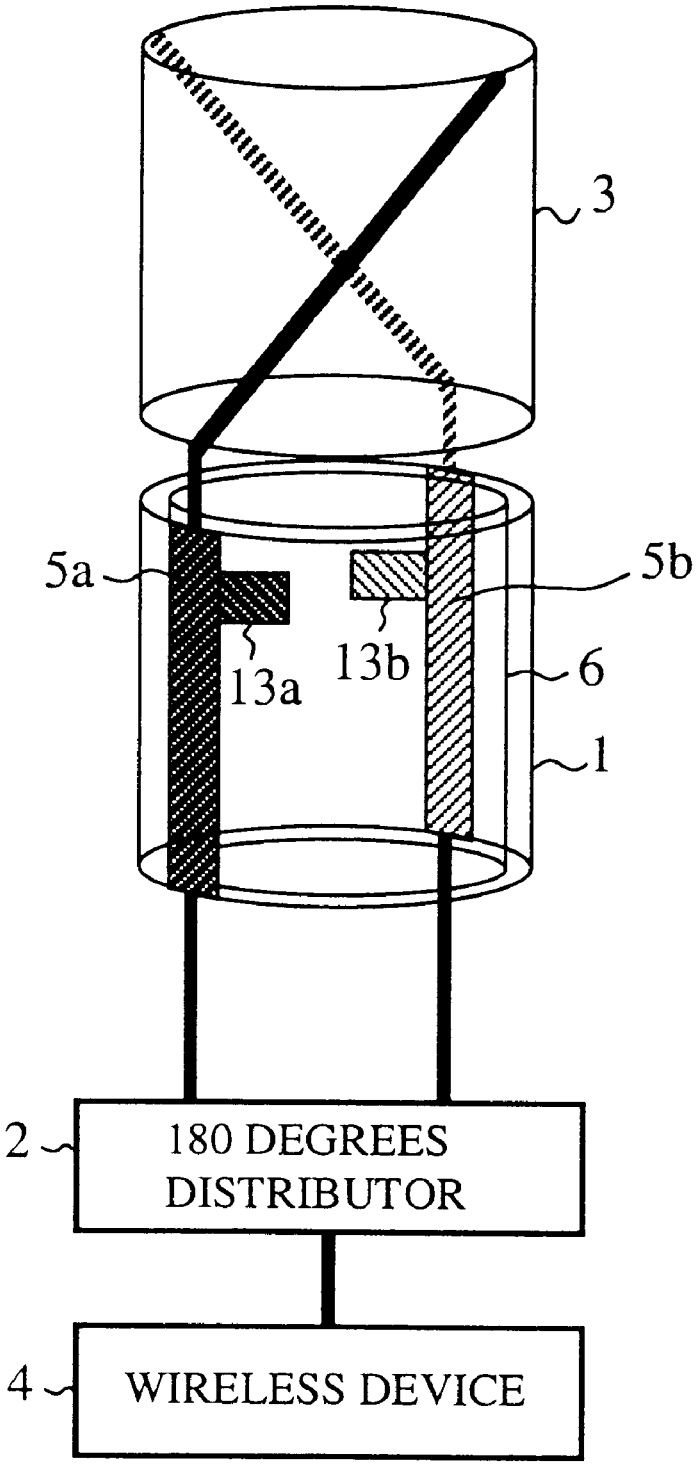
FIG. 7 is a schematic view of an antenna feeding circuit according to the fourth embodiment of the present invention.

FIG. 7 is a schematic view of an antenna feeding circuit according to the fourth embodiment of the present invention. In this embodiment, short stubs 13*a*, 13*b* are connected to the band conductors 5*a*, 5*b*. Components in the figure identical to those in the first embodiment shown in FIG. 1 are referred to the same reference numerals.

The function of the antenna feeding circuit according to the fourth embodiment of the present invention is explained below.

The band conductor 5*a*, 5*b* and the inner conductor 6 disposed at the whole of the inner surface of the cylindrical body 1 form micro-strips lines, so that the inutile currents in the inner conductor are cancelled out to each other in like manner as in the first embodiment. Furthermore the impedance matching between the band conductors 5*a*, 5*b* and the bifilar helical antenna element 3 are carried out by the short stubs 13*a*, 13*b* connected to each of the band conductors 5*a*, 5*b*.

According to the fourth embodiment, advantages can be obtained in that the structure of the antenna feeding circuit can be simplified; and that electric power can be effectively supplied to the bifilar antenna elements 3, using short stubs 13*a*, 13*b* as impedance matching elements, so that the efficiency of the electromagnetic wave radiation can be improved.

EMBODIMENT 5

Figure 8:
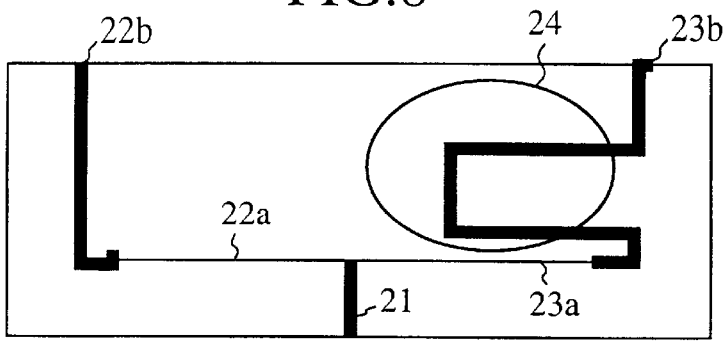
FIG. 8 is a schematic view of a 180 degree distribution circuit in an antenna feeding circuit according to the fifth embodiment of the present invention.

FIG. 8 is a schematic view of a 180 degree distribution circuit in an antenna feeding circuit according to the fifth embodiment of the present invention. In the figure, reference numerals 21, 22*a*, 23*a* denote, respectively, an input terminal of a T-branching circuit constituted from a micro-strips line, an output terminal of the T-branching circuit and another output terminal of the T-branching circuit. Reference numeral 24 denotes a delay micro-strips line for phase delay of 180 degrees at the using frequency, which is half of the characteristic electric length at the using frequency. Reference numerals 22*b*, 23*b* denote respectively micro-strips lines.

The function of the antenna feeding circuit according to the fifth embodiment of the present invention is explained below.

The electric power inputted from the input terminal 21 is distributed to the output terminals 22*a*, 23*a* at an equal amplitude and an equal phase. The phase of the current distributed to the output terminal 23*a* delays at 180 degrees due to the delay micro-strips line 24. As a result, a phase difference of 180 degrees appears between the outputs from the micro-strips line 22*b*, 23*b*.

According to the fifth embodiment, the structure of the antenna feeding circuit can be simplified.

EMBODIMENT 6

Figure 9:
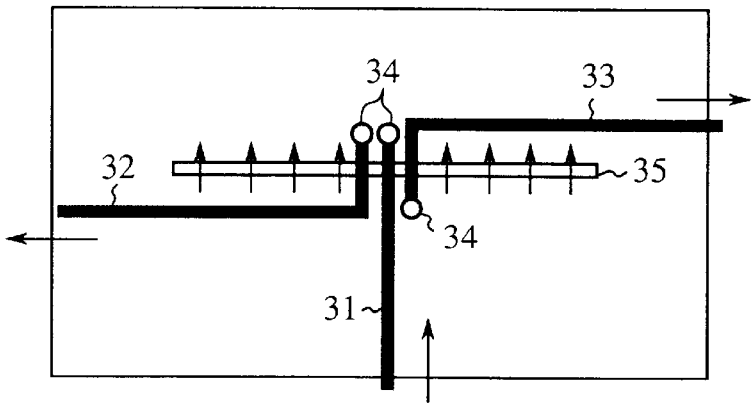
FIG. 9 is a schematic view of a 180 degree distribution circuit in an antenna feeding circuit according to the sixth embodiment of the present invention.
Figure 12:
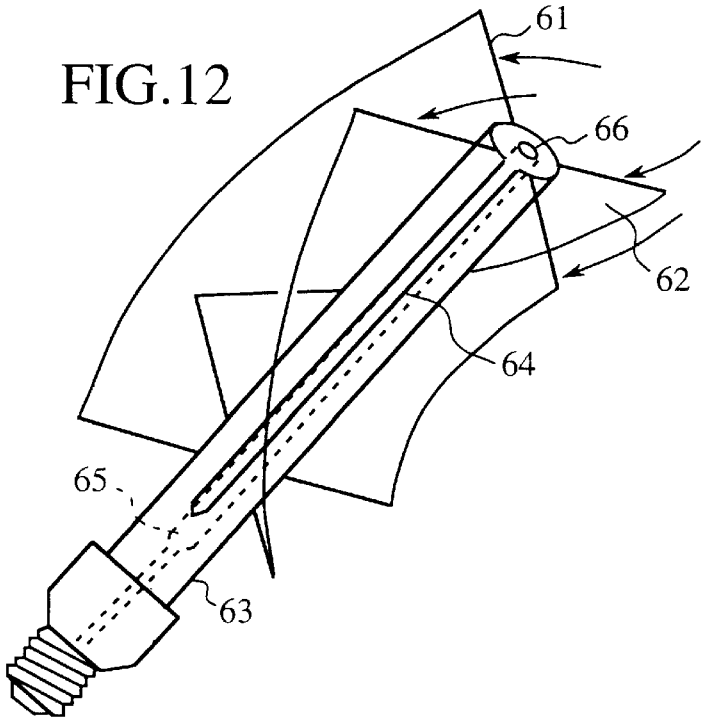
FIG. 12 is a schematic view of an antenna feeding circuit in the prior art.

FIG. 9 is a schematic view of a 180 degree distribution circuit in an antenna feeding circuit according to the sixth embodiment of the present invention. A T-branching circuit is constituted from three micro-strips lines 31, 32, 33. A first micro-strips line 31 is the input terminal of a T-branching circuit. Reference numeral 35 denotes a slot disposed in the substrate of the micro-strips lines so as to be perpendicular to the micro-strips line 31. The length of the slot 35 is substantially half of the wavelength at the using frequency, namely, half of the electric length at the using frequency. There are three through-holes 34 on the substrate. The first micro-strips line 31 is grounded to the substrate through a through-hole 34, which is disposed at a point where the first micro-strips line 31 just crossed over the slot 35 to the opposite side.

The second micro-strips line 32 is disposed at the same side as the first micro-strips line 31 and is grounded to the substrate through another through-hole 34, which is disposed at a point where the second micro-strips line 32 just crossed over the slot 35 to the opposite side.

The third micro-strips line 33 is disposed at the opposite side to the first micro-strips line 31 with respect to the slot 35 and is grounded to the substrate through a through-hole 34, which is disposed at a point where the third micro-strips line 33 just crossed over the slot 35 to the same side as the first micro-strips line 31. The function of the antenna feeding circuit according to the sixth embodiment of the present invention is explained below.

The electric power inputted from the micro-strips line 31 propagates along the micro-strips line 31 and induces an electric field in the slot 35. The induced electric field in the slot 35, in turn, induces electric fields in the second and third micro-strips lines 32, 33. The coupled field in the second micro-strips line 32 propagates in the equal phase as that of the first micro-strips line 31, because the first and second micro-strips lines 31, 32 are disposed at the same side with respect to the slot 35 and cross over the slot 35 in the same direction.

On the other hand, because the first and third micro-strips lines 31, 33 are disposed at the opposite side with respect to the slot 35, and they cross over the slot 35 in the opposite directions, the phase of the coupled electric field in the third micro-strips line 33 is inverse to the exiting field in the first micro-strips line 31. As a result, electric fields propagating in the second and third micro-strips lines 32, 33 have a phase difference of 180 degrees to each other. Consequently, the system as a whole functions as a 180 degree distributor.

According to the sixth embodiment, the structure of the antenna feeding circuit can be simplified.

EMBODIMENT 7

Figure 10:
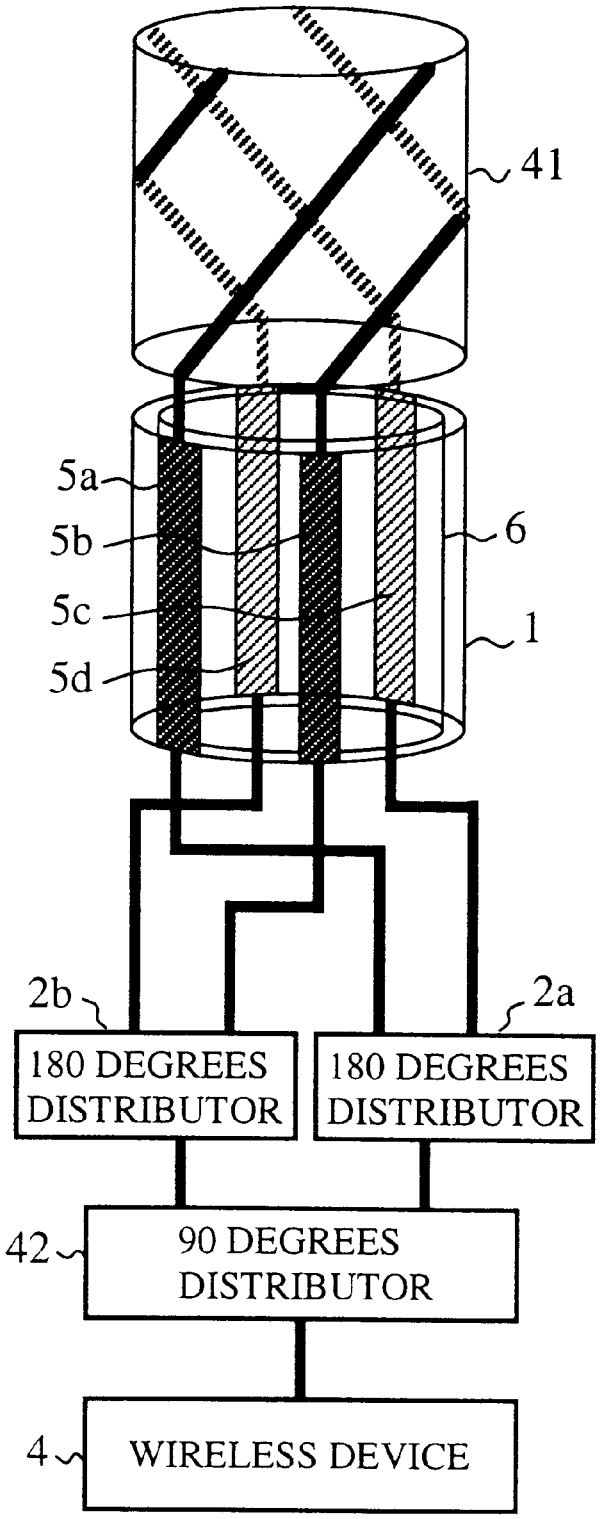
FIG. 10 is a schematic view of an antenna feeding circuit according to the seventh embodiment of the present invention.

FIG. 10 is a schematic view of an antenna feeding circuit according to the seventh embodiment of the present invention. Reference numeral 1 denotes an electrically insulating cylindrical body. Four band conductors 5*a*, 5*b*, 5*c*, 5*d* are disposed equidistantly on the outer surface of the cylindrical body 1 at positions symmetrical with respect to the axis of the cylinder so as to be parallel with the longitudinal direction of the cylinder. The band conductors are grouped into two pairs 5*a*, 5*c* and 5*b*, 5*d*. The whole of the inner surface of the cylindrical body 1 is covered with an inner conductor 6. The band conductors 5*a*, 5*b*, 5*c*, 5*d*, the cylindrical body 1 and the inner conductor 6 form micro-strips lines.

A first 180 degree distributors 2*a* is connected to an end of band conductors 5*a*, 5*c*, so as to supply electric power to each of the band conductors 5*a*, 5*c*, so that the phase difference of the currents flowing in them is 180 degrees. A second 180 degree distributors 2*b* is connected to an end of band conductors 5*b*, 5*d*, so as to supply electric power to the band conductors 5*b*, 5*d*, so that the phase difference of the current flowing in them is 180 degrees. A quadrifilar helical antenna 41 is connected to the other end of the band conductors 5*a*, 5*b*, 5*c*, 5*d*. A 90 degree distributor 42 supplies electric power to each of the first and second 180 degree distributors 2*a*, 2*b* so that the phase difference between the currents in the first and second 180 degree distributors is 90 degrees. Reference numeral 4 denotes a wireless device, which provides electric power to the 90 degree distributor 42.

The function of the antenna feeding circuit according to the seventh embodiment of the present invention is explained below.

Four band conductors 5*a*, 5*b*, 5*c*, 5*d* disposed on the outer surface of the cylindrical body and the inner conductor 6 disposed on the inner surface of the cylindrical body 6 form four micro-strips lines. Four band conductors 5*a*, 5*b*, 5*c*, 5*d* are grouped into two groups 5*a*, 5*c* and 5*b*, 5*c*. The band conductors in each group are configured at opposite positions on the outer surface of the cylindrical body. The former group 5*a*, 5*c* are connected to the first 180 degree distributor 2*a*, the later group 5*b*, 5*d* are connected to the second 180 degree distributors. The other ends of the band conductors 5*a*, 5*b*, 5*c*, 5*d* are connected respectively to a corresponding element of the quadrifilar antenna 41.

Because each group of the band conductors 5*a*, 5*c*; 5*b*, 5*d* are connected respectively with the first and second 180 degree distributors 2*a*, 2*b*, the inutile current induced in the inner surface of the inner conductor 6 can be cancelled out, in like manner as in the first embodiment.

Furthermore, the phase difference of the input signals to the first and second 180 degree distributors 2*a*, 2*b* is 90 degrees. Therefore the phases of the currents in the neighboring band conductors 5*a*, 5*b*, 5*c*, 5*d* connected to the first and second 180 degree distributors 2*a*, 2*b* differ by 90 degrees in a cyclic manner. And, the phases of the currents in the neighboring antenna elements in the quadrifilar antenna 41 connected to the band conductors differ by 90 degrees in a cyclic manner.

As explained, according to the seventh embodiment, band conductors 5*a*, 5*b*, 5*c*, 5*d* disposed on the outer surface of the cylindrical body 1 and the inner conductor 6 disposed on the whole of the inner surface of the cylindrical body 1 form micro-strips lines, and two 180 degree distributors 2*a*, 2*b* supplies electric power to the each group of band conductors 5*a*, 5*c*; 5*b*, 5*d* so that the phase difference between the currents in the band conductors in each group is 90 degrees. And the induced inutile currents in the inner surface of the inner conductor 6 can be cancelled out, because the inner conductor 6 is disposed on the whole of the inler surface of the cylindrical body 1. As a result, it is not necessary to use a balance-unbalance converter, i.e., a balun. And the structure of the antenna feeding circuit can be simplified. Furthermore, antenna feeding circuits for many antenna elements can be unified, when the outer surface of the cylindrical body are partitioned equidistantly for the band conductors.

EMBODIMENT 8

Figure 11:
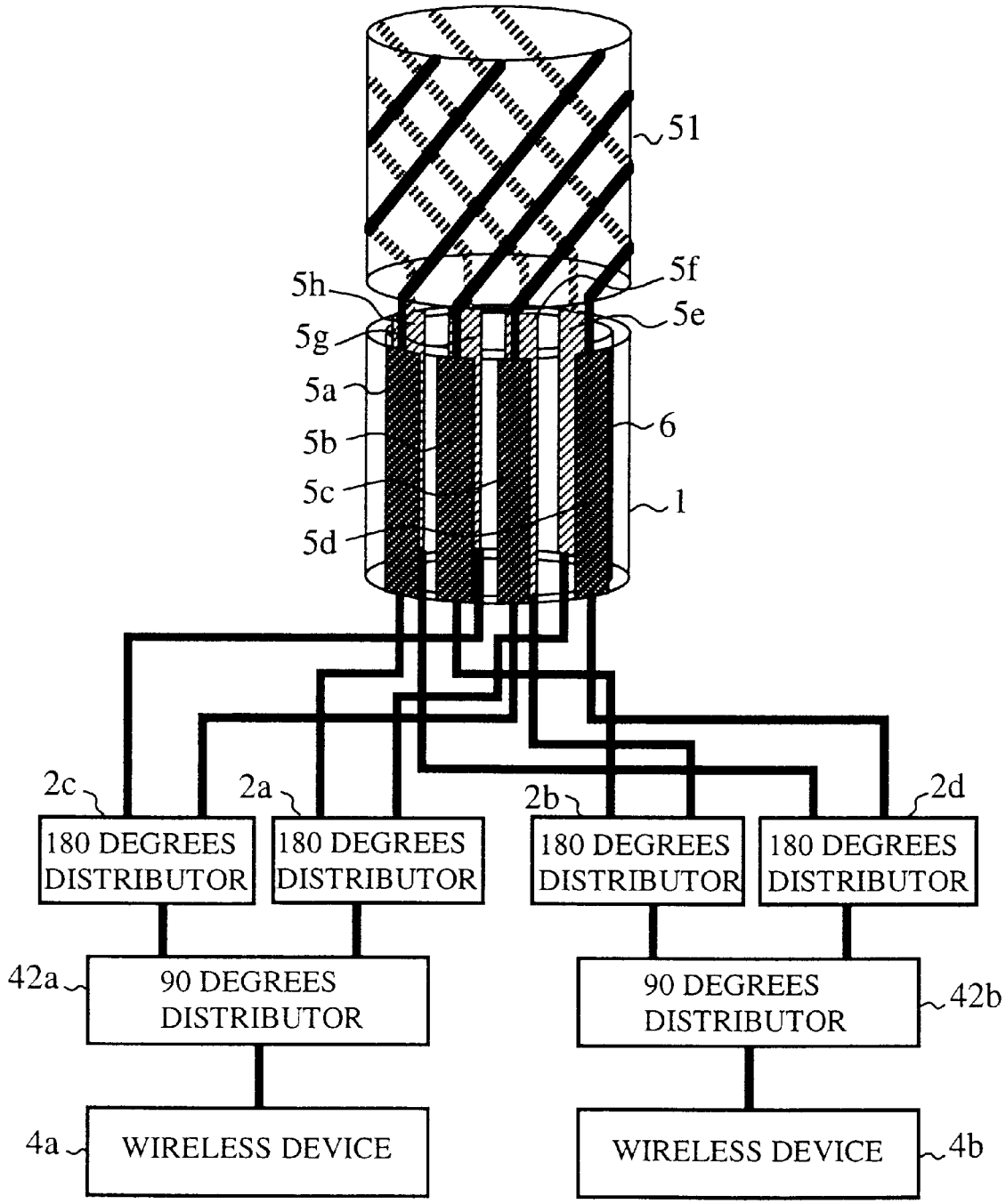
FIG. 11 is a schematic view of an antenna feeding circuit according to the eighth embodiment of the present invention.

FIG. 11 is a schematic view of an antenna feeding circuit according to the eighth embodiment of the present invention. Reference numeral 1 denotes an electrically insulating cylindrical body. Eight band conductors 5*a*, 5*b*, 5*c*, 5*d*, 5*e*, 5*f*, 5*g*, 5*h* are disposed equidistantly on the outer surface of the cylindrical body 1 at positions symmetrical with respect to the axis of the cylinder so as to be parallel with the longitudinal direction of the cylinder. The band conductors are grouped into four pairs 5*a*, 5*e*; 5*b*, 5*f*; 5*c*, 5*g*; and 5*d*, 5*h*. The whole of the inner surface of the cylindrical body 1 is covered with an inner conductor 6. Each of the band conductors 5*a*, 5*b*, 5*c*, 5*d*, 5*e*, 5*f*, 5*g*, 5*h*, the cylindrical body 1 and the inner conductor 6 form a micro-strips line.

A first 180 degree distributor 2*a* is connected to an end of band conductors 5*a*, 5*e*, so as to supply electric powers to each of the band conductors 5*a*, 5*e*, so that the phase difference of the currents in the band conductors is 180 degrees. A second 180 degree distributor 2*b* is connected to an end of band conductors 5*b*, 5*f*, so as to supply electric powers to the band conductors 5*b*, 5*f*, so that the phase difference of the currents in the band conductors is 180 degrees. A third 180 degree distributor 2*c* is connected to an end of band conductors 5*c*, 5*g*, so as to supply electric power to each of the band conductors 5*c*, 5*g*, so that the phase difference of the currents in the band conductors is 180 degrees. A fourth 180 degree distributor 2*d* is connected to an end of band conductors 5*d*, 5*h*, so as to supply electric power to the band conductors 5*d*, 5*h*, so that the phase difference of the currents in the band conductors is 180 degrees.

An octifilar helical antenna 51 is connected to the other end of the band conductors 5*a*, 5*b*, 5*c*, 5*d*, 5*e*, 5*f*, 5*g*, 5*h*. A first 90 degree distributor 42*a* supplies electric power to each of the first and third 180 degree distributors 2*a*, 2*c* so that the phase difference between the currents in them is 90 degrees. A second 90 degree distributor 42*b* supplies electric power to each of the second and fourth 180 degree distributors 2*b*, 2*d* so that the phase difference between the currents in them is 90 degrees. Reference numeral 4*a* denotes a first wireless device, which provides electric power to the first 90 degree distributor 42*a*. Reference numeral 4*b* denotes a second wireless device, which provides electric power to the second 90 degree distributor 42*b*.

The function of the antenna feeding circuit according to the eighth embodiment of the present invention is explained below.

Eight band conductors 5*a*, 5*b*, 5*c*, 5*d*, 5*e*, 5*f*, 5*g*, 5*h* disposed on the outer surface of the cylindrical body and the inner conductor 6 disposed on the inner surface of the cylindrical body 6 form eight micro-strips lines. Eight band conductors 5*a*, 5*b*, 5*c*, 5*d*, 5*e*, 5*f*, 5*g*, 5*h* are grouped into four groups 5*a*, 5*e*; 5*b*, 5*f*; 5*c*, 5*g*; 5*d*, 5*h*. The band conductors in each group is configured at opposite positions on the outer surface of the cylindrical body. The first group 5*a*, 5*e* is connected to the first 180 degree distributor 2*a*, the second group 5*b*, 5*f* is connected to the second 180 degree distributor 2*b*, the third group is connected to the third 180 degree distributor 2*c* and the fourth group is connected to the fourth 180 degree distributor 2*d*.

The other ends of each of the band conductors 5*a*, 5*b*, 5*c*, 5*d*, 5*e*, 5*f*, 5*g*, 5*h* are connected to an element of the octifilar antenna 51, respectively.

Because each group of the band conductors 5*a*, 5*c*; 5*b*, 5*f*; 5*c*, 5*g*; 5*d*, 5*h* are connected with the first to fourth 180 degree distributors 2*a*, 2*b*, 2*c*, 2*d*, the inutile current induced in the inner surface of the inner conductor 6 can be cancelled out, in like manner as in the first embodiment.

Furthermore, the phase difference of the input signals from the first 90 degree distributor 42*a* to the first and third 180 degree distributors 2*a*, 2*c* is 90 degrees. Therefore, the phase difference between the current in the band conductor 5*a* connected with the first 180 degree distributor 2*a* and the current in the band conductor 5*c* connected with the third 180 degree distributor 2*c* is 90 degrees. Similarly, the phase difference between the input signals to the second and fourth 180 degree distributors 2*b*, 2*d* from the second 90 degree distributor 42*b* is 90 degrees. Therefore, the phase difference between the current in the band conductor 5*b* connected with the second 180 degree distributor 2*b* and the current in the band conductor 5*d* connected with the fourth 180 degree distributor 2*d* is 90 degrees.

Therefore, the phases of the currents in each two band conductors 5*a*, 5*c*, 5*e*, 5*g*; 5*b*, 5*d*, 5*f*, 5*h* in the octifilar antenna 51 differ by 90 degrees in a cyclic manner. As a result, the octifilar antenna 51 functions as two sets of quadrifilar antenna comprising each two elements in the octifilar antenna.

According to the eighth embodiment, band conductors 5*a*, 5*b*, 5*c*, 5*d*, 5*e*, 5*f*, 5*g*, 5*h* disposed on the outer surface of the cylindrical body 1 and the inner conductor 6 disposed on the whole of the inner surface of the cylindrical body 1 form micro-strips lines, and first to fourth 180 degree distributors 2*a*, 2*b*, 2*c*, 2*d* supply electric power to each group of band conductors 5*a*, 5*e*; 5*b*, 5*f*; 5*c*, 5*g*; 5*d*, 5*h* so that the phase difference between the currents in the band conductors in each group is 180 degrees. And the induced inutile currents at the inner surface of the inner conductor 6 can be cancelled out, because the inner conductor 6 is disposed on the whole of the inner surface of the cylindrical body 1. As a result, it is not necessary to use a balance-unbalance converter, i.e., a balun. And the structure of the antenna feeding circuit can be simplified. Furthermore, antenna feeding circuits for many antenna elements can be unified, when the outer surface of the cylindrical body are partitioned equidistantly.

ADVANTAGES OF THE PRESENT INVENTION

According to the present invention, the inner conductor and a pair of band conductors disposed on the outer surface of the cylindrical body form micro-strips lines. And inutile currents induced in the inner surface of the inner conductor can be cancelled out, because the inner conductor is disposed on the whole of inner surface of the cylindrical body, so that no balance-unbalanced converter, a balun, is necessary. That is to say, the structure of an antenna feeding circuit can be simplified.

In an embodiment of the present invention, an impedance matching circuit is disposed at the joint portion between the helical antenna and the antenna feeding circuit, therefore, electric power can be effectively supplied to the helical antenna so that the efficiency of the electromagnetic radiation can be improved.

In an embodiment of the present invention, a plurality of pairs of band conductors are disposed on the outer surface of the cylindrical body, so that a plurality of antenna feeding circuits for multi-element helical antenna can be unified.

The antenna feeding circuit according to the present invention can be employed in feeding a helical antenna.

What is claimed is:

1. An antenna feeding circuit comprising:

a cylindrical body;

said cylindrical body having an inner and an outer surface;

an inner conductor disposed on the inner surface of the cylindrical body;

one or more pairs of electrically conductive bands disposed on the outer surface of the cylindrical body at a position symmetrical with respect to the axis of the cylindrical body so as to be parallel with the longitudinal direction of the cylindrical body, wherein each of electrically conductive bands has a first end and a second end for connecting an antenna element of a helical antenna;

one or more 180 degree distributors, connected to the first end of each of the band conductors, for supplying electric current to each of the band conductors through the first end, so that the phase difference between the electric currents in the band conductors is 180 degrees;

wherein each of the electrically conductive bands induce an inverse inutile current in the inner conductor.

2. An antenna feeding circuit according to claim 1, wherein an impedance matching circuit is connected to the band conductor.

3. An antenna feeding circuit according to claim 2, wherein the impedance matching circuit is a capacitor element.

4. An antenna feeding circuit according to claim 2, wherein the impedance matching circuit is a meander line.

5. An antenna feeding circuit according to claim 2, wherein the impedance matching circuit is a short stub.

6. An antenna feeding circuit according to claim 1, wherein the 180 degree distributor comprises:

a T-branching circuit having an input terminal and a pair of output terminals, which are T-branched from the input terminal; and a delay line connected to either of the output terminals, the length of the delay line being equal to a half of the wavelength of a frequency in use.

7. An antenna feeding circuit according to claim 1, wherein the 180 degree distributor comprises:

a T-branching circuit comprising:

a first micro-strips line having an input terminal;

second and third micro-strips lines each having an output terminal, which are T-branched from the first micro-strips line;

a slot disposed on the substrate of the T-branching circuit so as to be perpendicular to the first micro-strips line, the length of the slot being substantially equal to half of the wavelength of a frequency in use;

wherein the first micro-strips line is grounded at a point on a side opposite to the input terminal of the first micro-strips line with respect to the slot;

the second micro-strips line is disposed on the same side as the input terminal of the first micro-strips line and is grounded at a point on the side opposite to the input terminal of the first micro-strips line with respect to the slot;

the third micro-strips line is disposed on the side opposite to the input terminal of the first micro-strips line and is grounded at a point on the same side as the input terminal of the first micro-strips line with respect to the slot.

8. An antenna feeding circuit according to claim 1, wherein said pair of electrically conductive bands is comprised of a first and second pair of electrically conductive bands;

said 180 degree distributor is comprised of a first 180 degree distributor for supplying electric current to the first pair of electrically conductive bands so that phase difference between the electric currents supplied to the first pair of electrically conductive bands is 180 degrees;

a second 180 degree distributor for supplying electric current to the second pair of electrically conductive bands so that phase difference between the electric currents supplied to the second pair of electrically conductive bands is 180 degrees;

said first and second 180 degree distributors are connected to a 90 degree distributor, which supplies electric current to said first and second 180 degree distributors so that the phase difference between the electric currents supplied to the first and second 180 degree distributors is 90 degrees.

9. An antenna feeding circuit according to claim 1, wherein said pair of electrically conductive bands is comprised of a first, second, third and fourth pair of electrically conductive bands; and said 180 degree distributor is comprised of:

a first 180 degree distributor for supplying electric current to the first pair of electrically conductive bands so that the phase difference between the electric currents supplied to the first pair of electrically conductive bands is 180 degrees;

a second 180 degree distributor for supplying electric current to the second pair of electrically conductive bands so that the phase difference between the electric currents supplied to the second pair of electrically conductive bands is 180 degrees;

a third 180 degree distributor for supplying electric current to the third pair of electrically conductive bands so that the phase difference between the electric currents supplied to the third pair of electrically conductive bands is 180 degrees; and a fourth 180 degree distributor for supplying electric current to the fourth pair of electrically conductive bands so that the phase difference between the electric currents supplied to the fourth pair of electrically conductive bands is 180 degrees; wherein:

said first and third 180 degree distributors are connected to a first 90 degree distributor, which supplies electric current to said first and third 180 degree distributors so that the phase difference between the electric currents supplied to the first and third 180 degree distributors is 90 degrees; and said second and fourth 180 degree distributors are connected to a second 90 degree distributor, which supplies electric current to said second and fourth 180 degree distributors so that the phase difference between the electric currents supplied to the second and fourth 180 degree distributors is 90 degrees.

* * * * *

UNITED STATES PATENT AND TRADEMARK OFFICE

CERTIFICATE OF CORRECTION

PATENT NO. : 6,204,827 B1
DATED : March 20, 2001
INVENTOR(S) : Tsutomu Endo et al.

It is certified that error appears in the above-identified patent and that said Letters Patent is hereby corrected as shown below:

Column 10,
Line 6, "5c" should be -- 5e --.

Signed and Sealed this

Eleventh Day of March, 2003

JAMES E. ROGAN
*Director of the United States Patent and Trademark Office*